US006276182B1

(12) United States Patent
Cernuschi et al.

(10) Patent No.: US 6,276,182 B1
(45) Date of Patent: Aug. 21, 2001

(54) ROLLING STAND, HAVING THREE OR MORE SWINGING AND ADJUSTABLE ARMS

(75) Inventors: Ettore Cernuschi, Bareggio; Maurizio Brignoli, Romano di Lombardia; Stefano Bandini, Milan, all of (IT)

(73) Assignee: SMS Demag Innse SpA, Milan (IT)

( * ) Notice: Subject to any disclaimer, the term of this patent is extended or adjusted under 35 U.S.C. 154(b) by 0 days.

(21) Appl. No.: 09/646,271

(22) PCT Filed: Mar. 2, 1999

(86) PCT No.: PCT/EP99/01402

§ 371 Date: Sep. 15, 2000

§ 102(e) Date: Sep. 15, 2000

(87) PCT Pub. No.: WO99/47284

PCT Pub. Date: Sep. 23, 1999

(30) Foreign Application Priority Data

Mar. 18, 1998 (IT) ..... MI98A0547

(51) Int. Cl.[7] ..... B21B 13/10
(52) U.S. Cl. ..... 72/224; 72/235; 72/237
(58) Field of Search ..... 72/224, 234, 235, 72/237

(56) References Cited

U.S. PATENT DOCUMENTS 5,331,835 * 7/1994 Palma et al. ..... 72/224
5,765,423 * 6/1998 Cattaneo et al. ..... 72/224

FOREIGN PATENT DOCUMENTS

| | | |
|---|---|---|
| 917 963 | 1/1950 | (DE) . |
| 0 565 772 | 10/1993 | (EP) . |
| 1254864 | 10/1995 | (IT) . |
| 1264032 | 9/1996 | (IT) . |

* cited by examiner

*Primary Examiner*—Ed Tolan
(74) *Attorney, Agent, or Firm*—Griffin & Szipl, P.C.

(57) ABSTRACT

The invention relates to a mill for rolling pipes or other bodies such as flat blooms, bars, rods and the like. The rolling mill is formed by an outer load-bearing structure in which holders are accommodated so as to be extractable therefrom; in the holders there are mounted lever arms (18, 19, 20) that are pivotable transversely to the rolling axis along which the pipes or bodies to be rolled advance. The arms support the working rolls (48, 49, 50) at one end and, at the other end, are secured to the respective holder by means of a pin (22, 23, 24). In the rolling mill of the invention, there are advantageously means for rotating the olders about the rolling axis; this enables the rolls (48–50) to be brought back to the ideal working condition when their dimensions are reduced as a result of periodic machining to which they are subjected for maintenance and their working attitude can no longer be reestablished solely by the swinging movement of the lever arms (18–20) that support them.

13 Claims, 10 Drawing Sheets

ROLLING STAND, HAVING THREE OR MORE SWINGING AND ADJUSTABLE ARMS

Figure 3B:
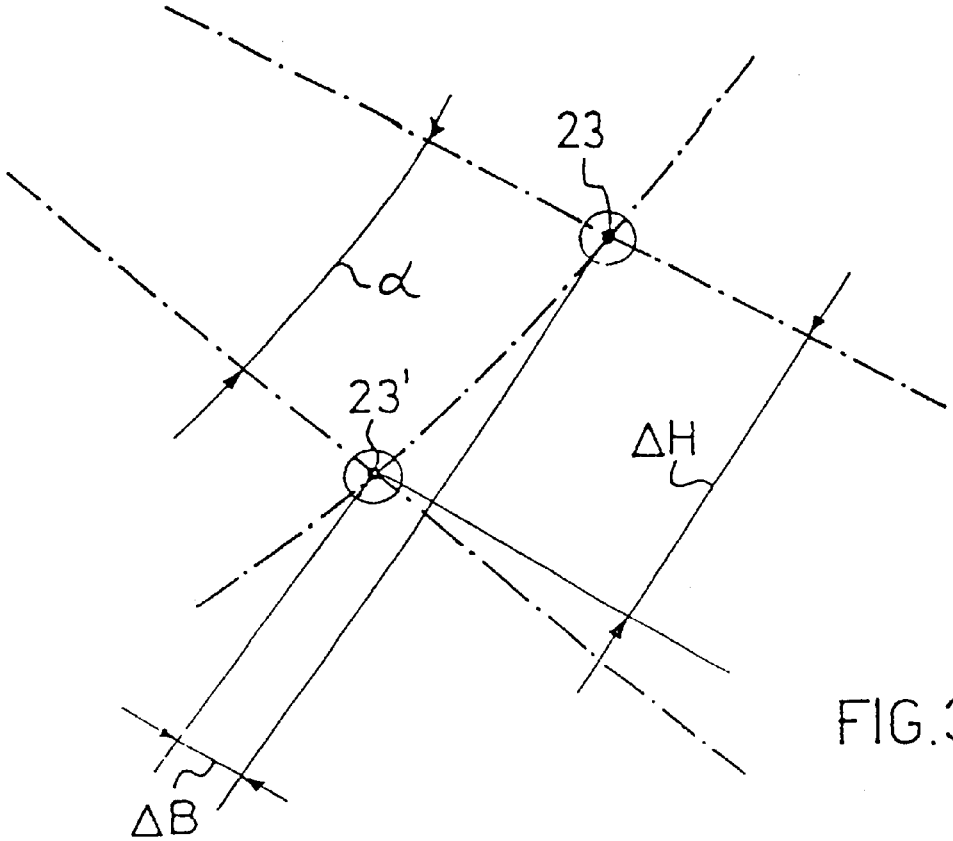

The present invention relates to the rolling of metal pipes and, in particular, of seamless pipes; it may, however also be used in the rolling of rod-shaped bodies in general, such as flat blooms, bars, wire rods, and the like.

Before proceeding further, it should therefore be pointed out that in this description and in the following claims, for sake of brevity, reference will be made mainly to the rolling of pipes; however, what will be stated is to be considered valid also for the above-mentioned rod-shaped bodies, unless specified otherwise.

Relevant improvements have been made in this field during recent years, concerning rolling mills with stands or rolling units with three or more driven rolls; rolling mills produced in accordance with this concept, in fact allow a better quality of work to be achieved than conventional mills with stands having two opposed rolls.

They are therefore preferable from this point of view, but their practical construction involves some considerable difficulties, amongst which there is the adjustment under load. As explained fully in Italian patents Nos. 1254864 and 1264032, to which reference is made for this purpose, this kind of adjustment consists in checking the distance of the axes of rotation of the rolls from the rolling axis along which the pipe to be processed advances, and it has a series of considerable technical difficulties when it must be performed in rolling mills with rolling stands having three or more driven rolls.

In short, these difficulties can be said to have been overcome by mounting the working rolls on respective lever arms swinging in planes transverse to the rolling axis and hinged on a supporting holder or frame which can be extracted from the outer structure of the rolling mill; this structure may advantageously be substantially tubular or open along a side.

In the first case it is particularly suitable for processing pipes on a mandrel because its closed configuration around the rolling axis, compensates best for the considerable radial stresses which arise during this type of working. In the second case, on the other hand, changes and maintenance of the rolls are facilitated, given that each holder on which the respective swinging arms are hinged can be extracted and inserted independently from the others, by simply moving it radially relative to the rolling axis in the region of the open side of the structure.

An important aspect concerning the maintenance of the rolling mills herein considered, consists in periodic re-turning of their rolls; indeed the working surfaces of the latter, which are shaped with a characteristic grooved profile, inevitably wear or are damaged over time so that in order to maintain a good quality of working, the rolls are re-turned after a certain period and are thus brought back to the required operative conditions.

This turning operation is carried out for removing a layer of material from the working surfaces of the rolls, however having care of keeping their profiles unchanged since they have to correspond to the external profile of the pipes to be rolled; upon completion of the returning, the rolls thus have a nominal dimension along their grooved profile which is reduced by a value equal to twice the thickness of material removed along their diameters. In order to roll pipes of predetermined diameter, it is possible to compensate for small values of this machining reduction by the adjustment of the trin of the rolling mill which is permitted by the swinging arms; beyond certain limits, however, this is no longer possible and it is precisely the situation which occurs when the rolls undergo several returning operations.

Figure 1:
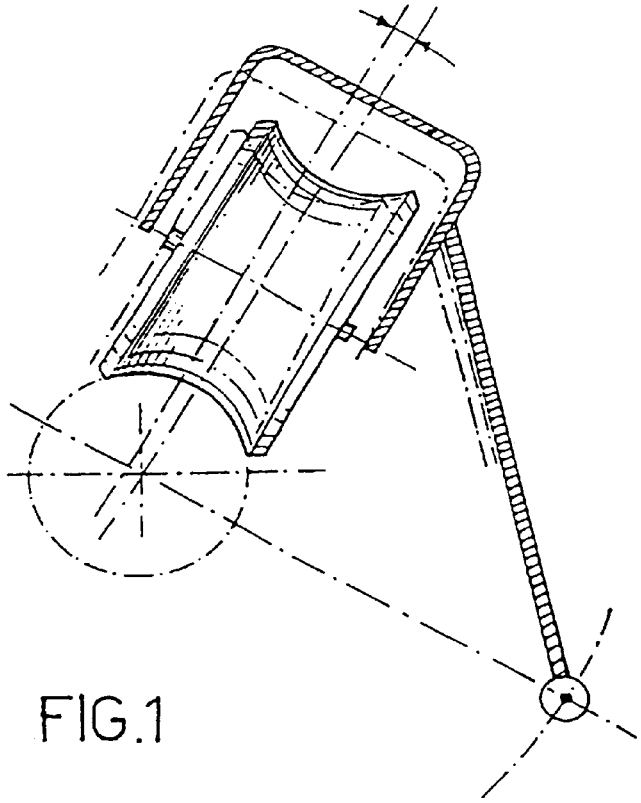

FIG. 1 of the appended drawings shows this situation and it can be seen therein that, when a large thickness has been removed from the surface of the roll, the swinging of the respective lever arm necessary to bring the grooved profile of the roll in a suitable position for rolling a pipe of predetermined outside diameter, leads to a displacement of the roll from its original plane of symmetry (that is, its median plane passing through the rolling axis of the pipe before the re-turning operation/s) which is unacceptable for correct rolling. To overcome this problem, it is known from the Italian patents indicated above to hinge the lever arms about pins mounted in an adjustable manner on the supporting frame or holder already mentioned; that is to say, according to this solution for compensating the effect just described due to the re-turning of the rolls, the position of the pin about which the lever arms pivot is adjusted. This operation is performed manually by operators attending the maintenance of the mill.

It is however clear that this adjustment, which is not always easy to do since various encrustations and deposits resulting from the rolling process may arise in the regions concerned, has to be repeated for each pin of a holder; since there are three or more lever arms for each holder and there may also be six or more holders in a rolling mill, it is easy to understand that the time and procedures required to adjust all of the pins may become quite lengthy and onerous.

The object of the present invention is therefore to remedy such a situation. In other words, the invention aims at providing a rolling mill of the type with lever arms swinging transversely to the rolling axis, and where these arms are disposed on holders extractable from an outer load-bearing structure, which permits an adjustment of the positions of the pivot points of the arms such as to overcome the problems of the prior art considered above.

This object is achieved by a rolling mill the features thereof are set forth in the claims appended to this description.

Figure 2:
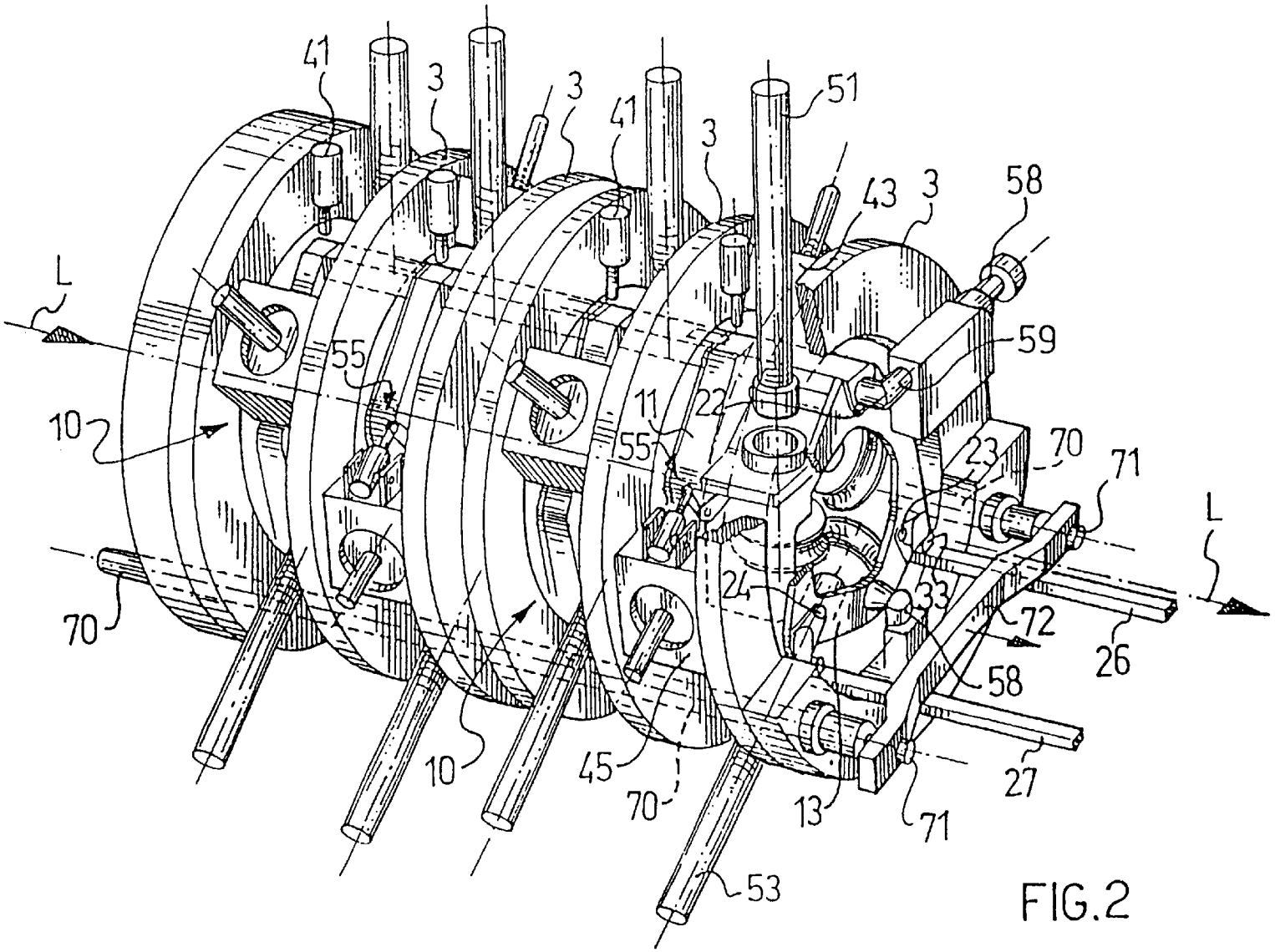
Figure 3:
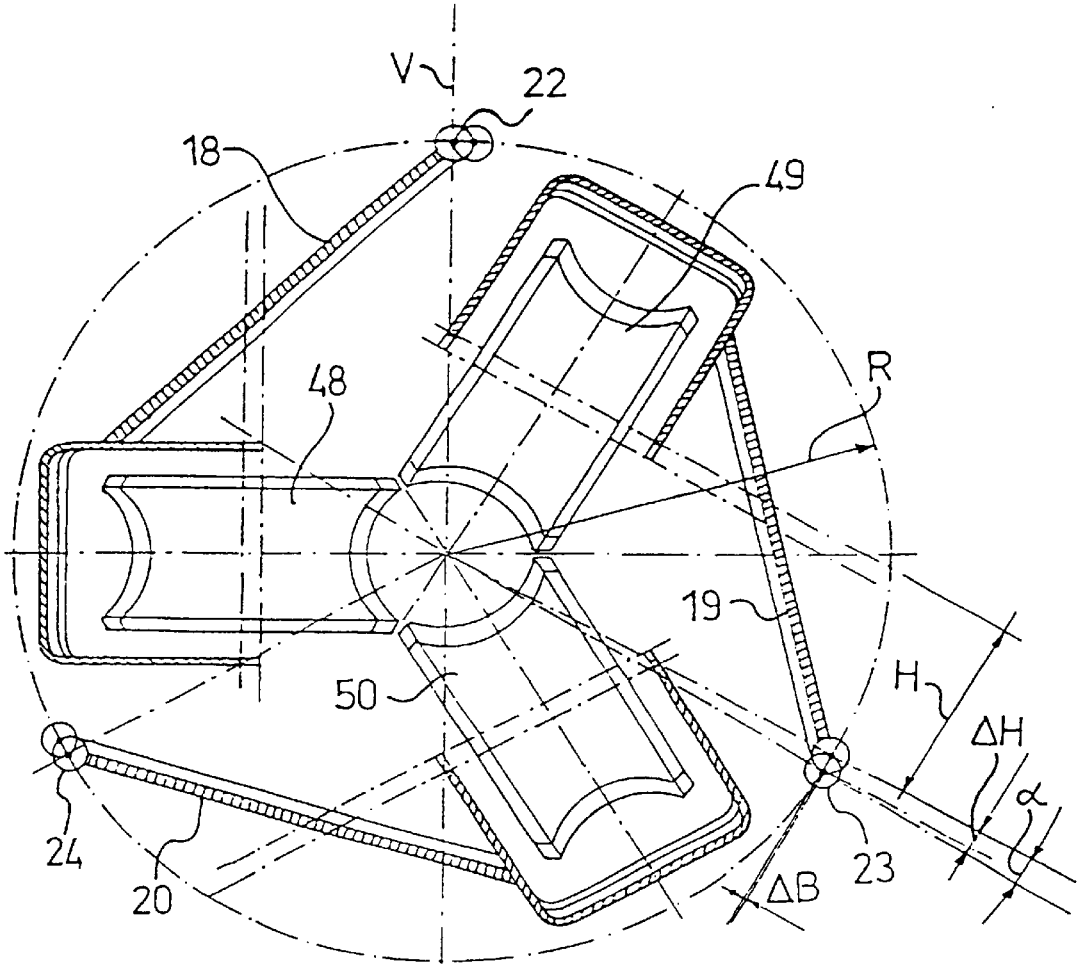
Figure 3A:
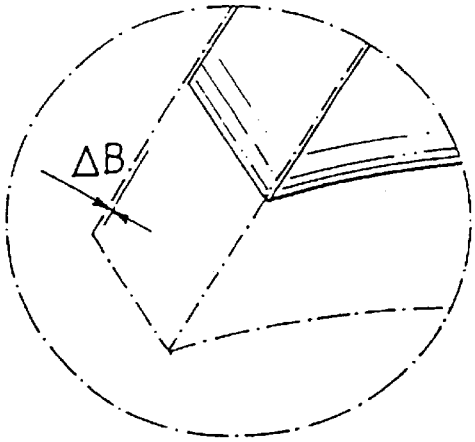
Figure 4:
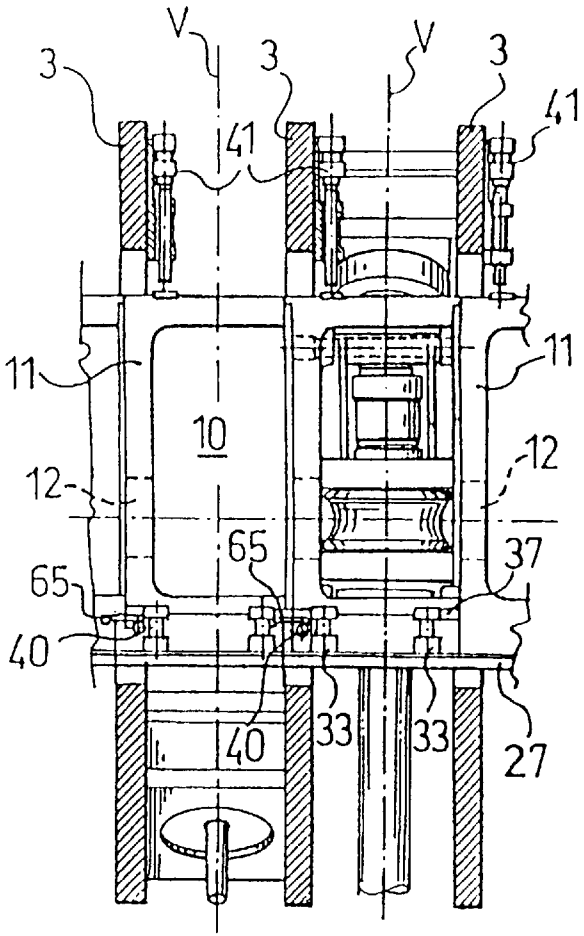
Figure 5:
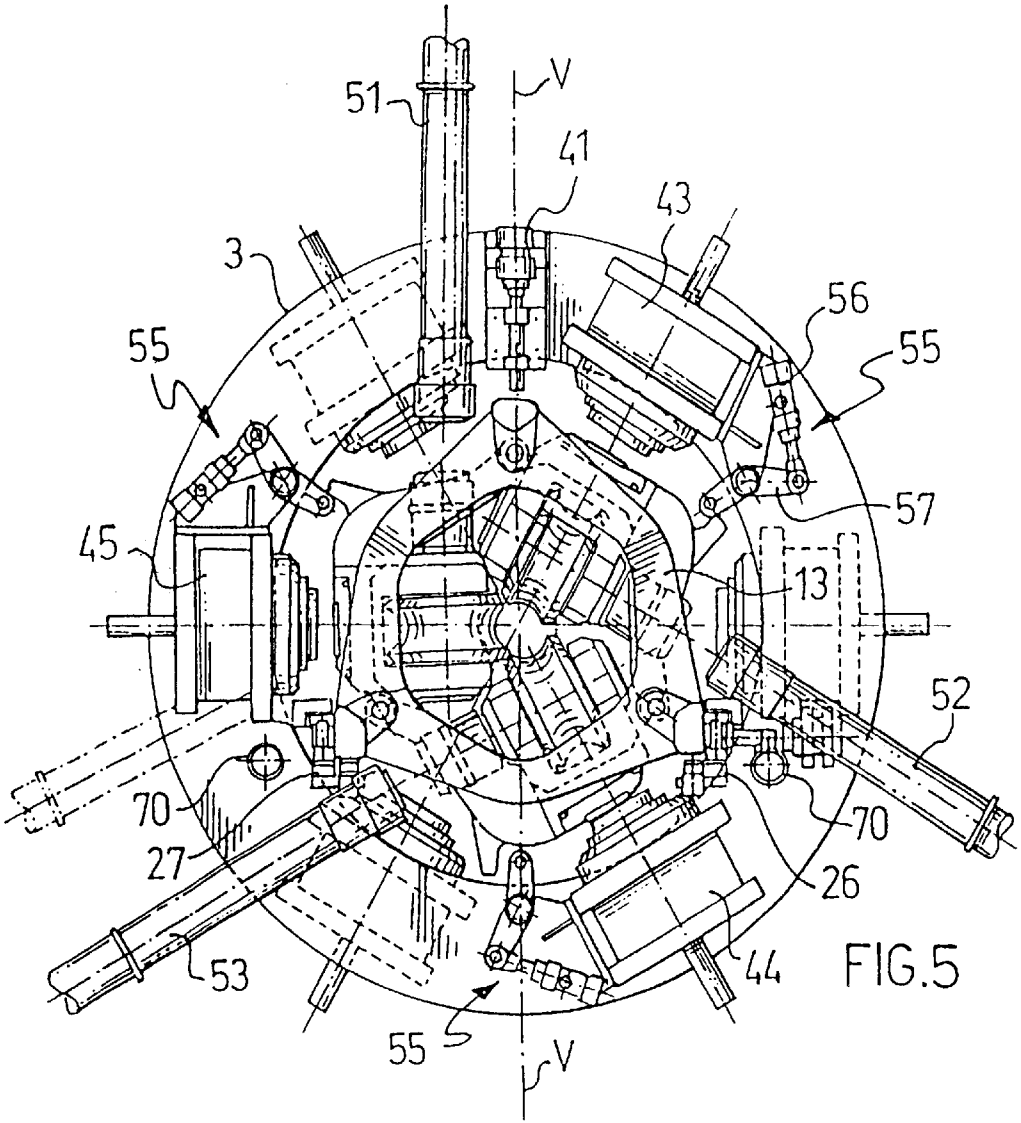
Figure 7:
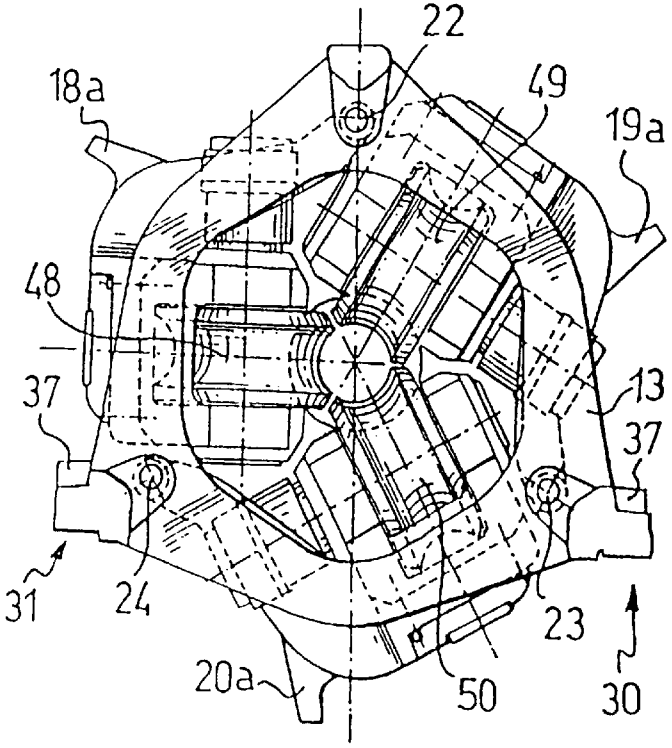
Figure 6:
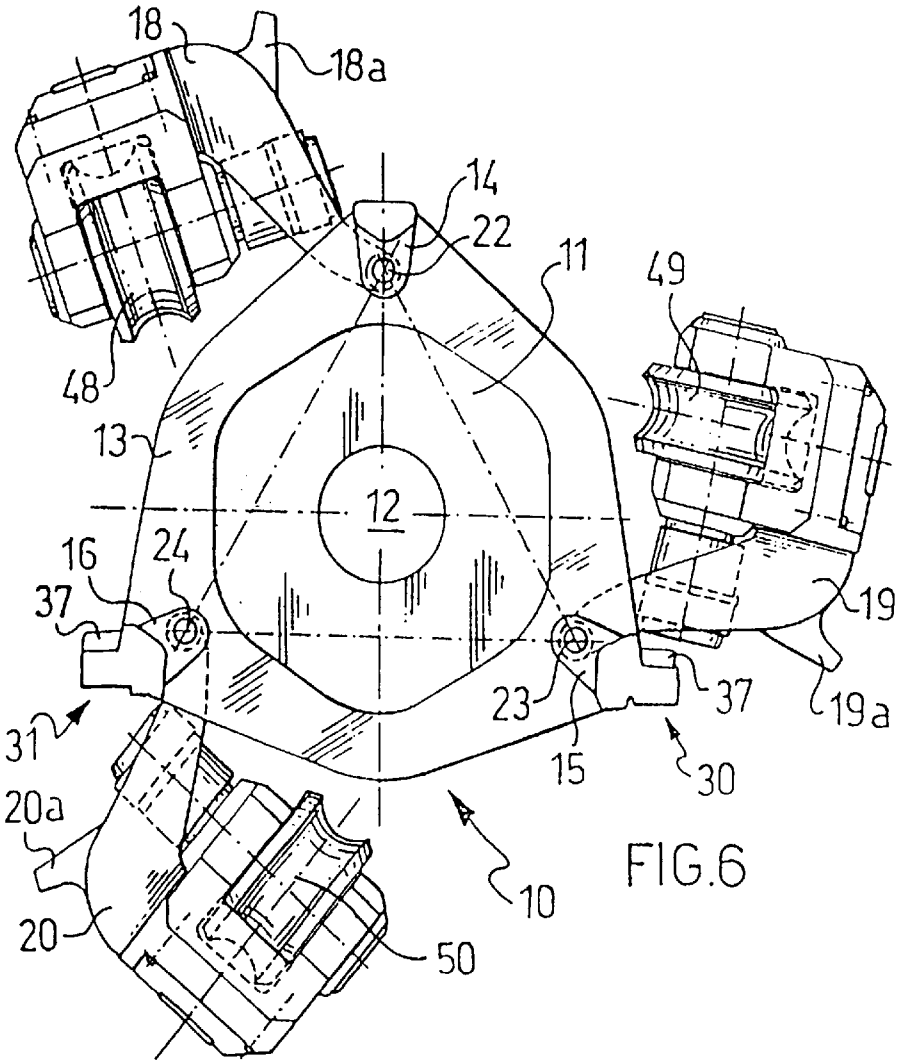
Figure 8:
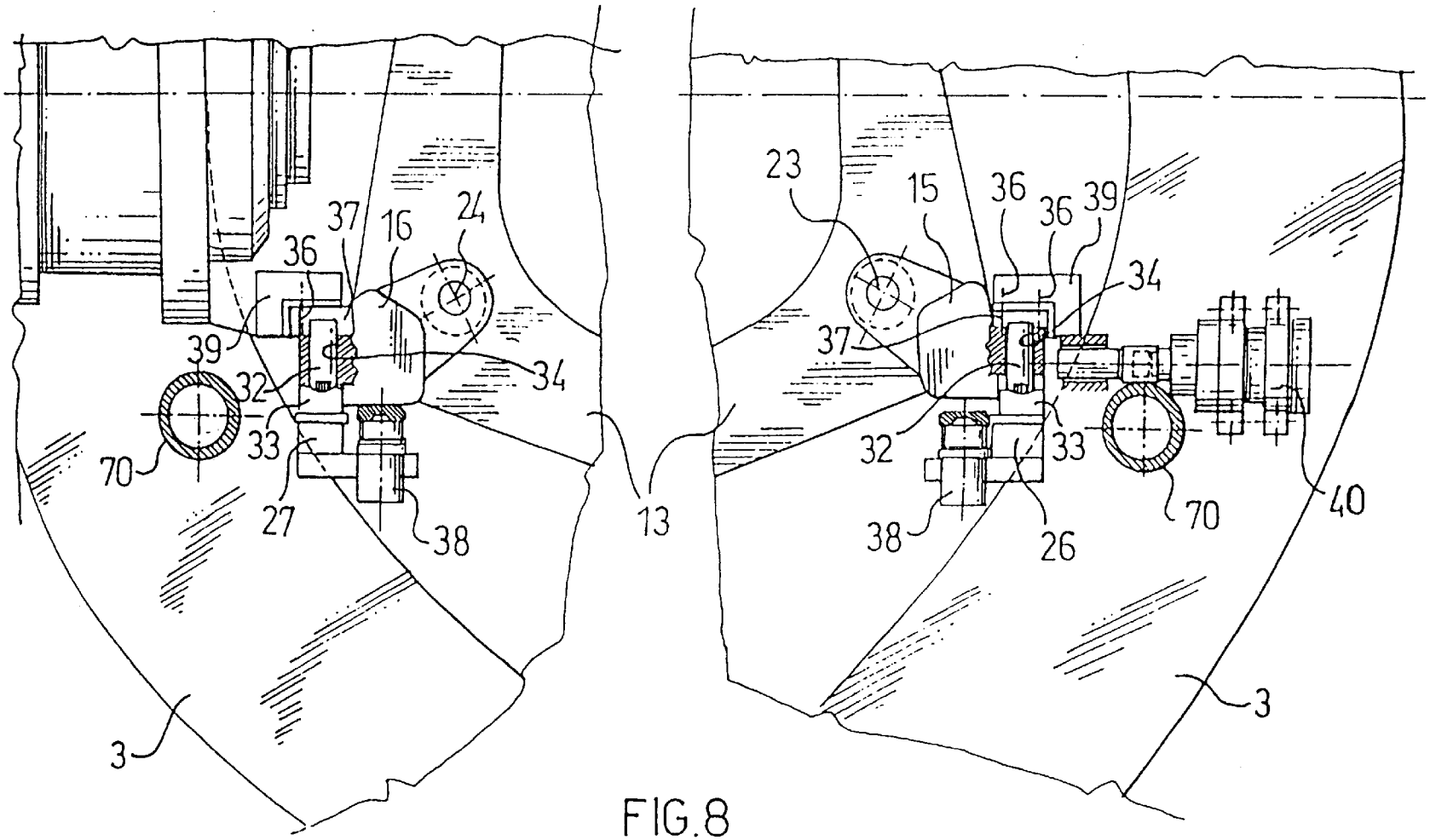
Figure 9:
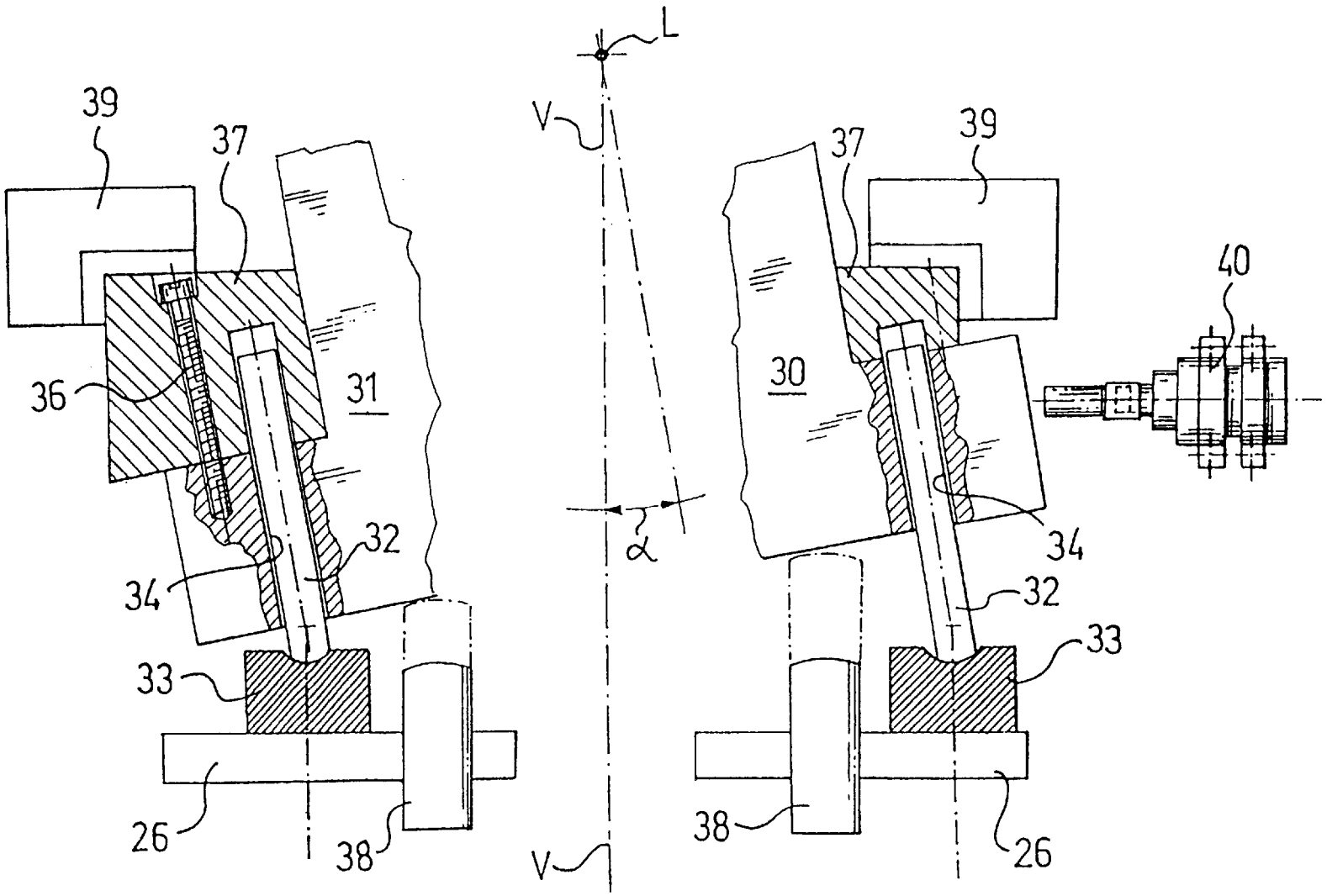
Figure 10:
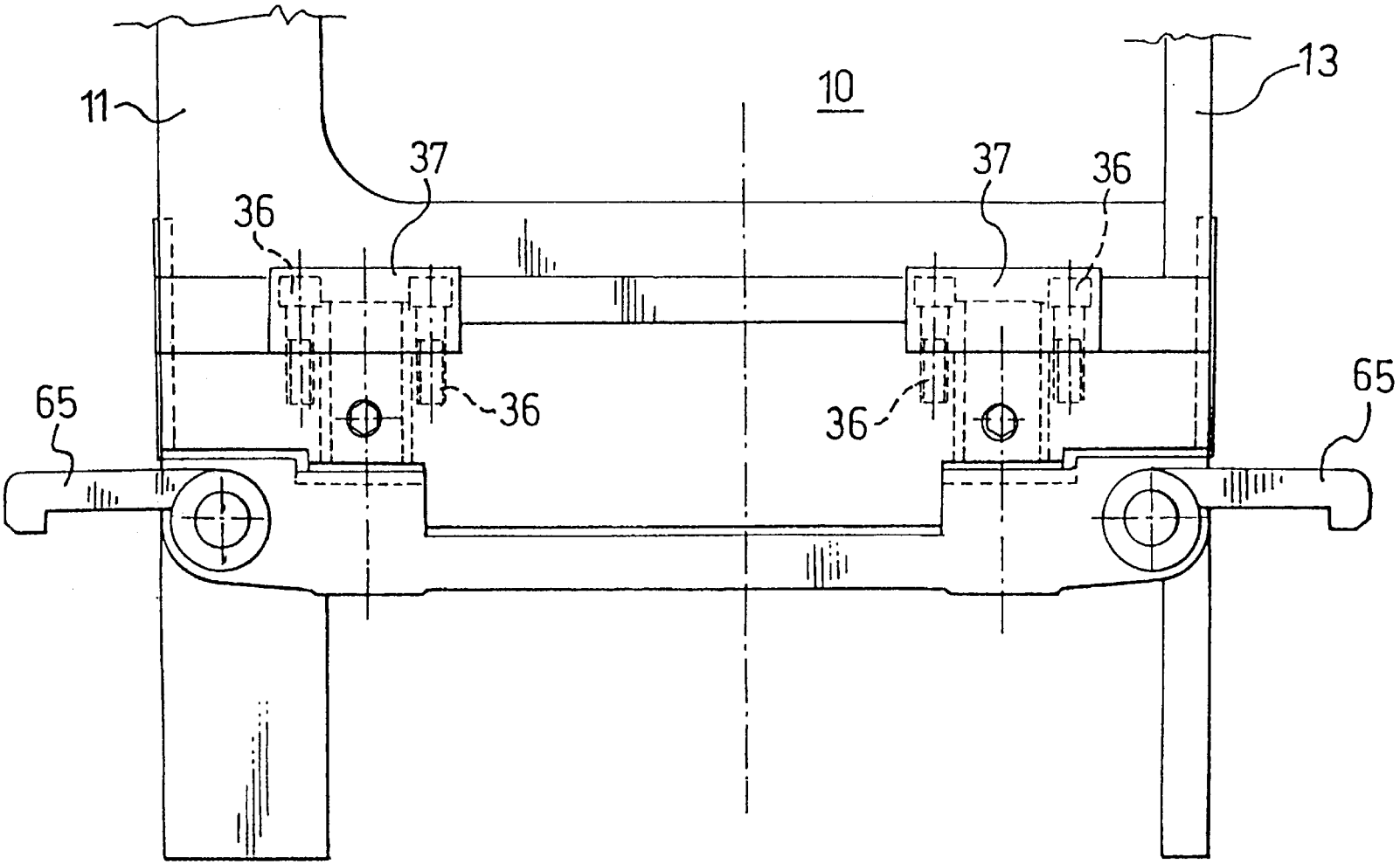
Figure 11:
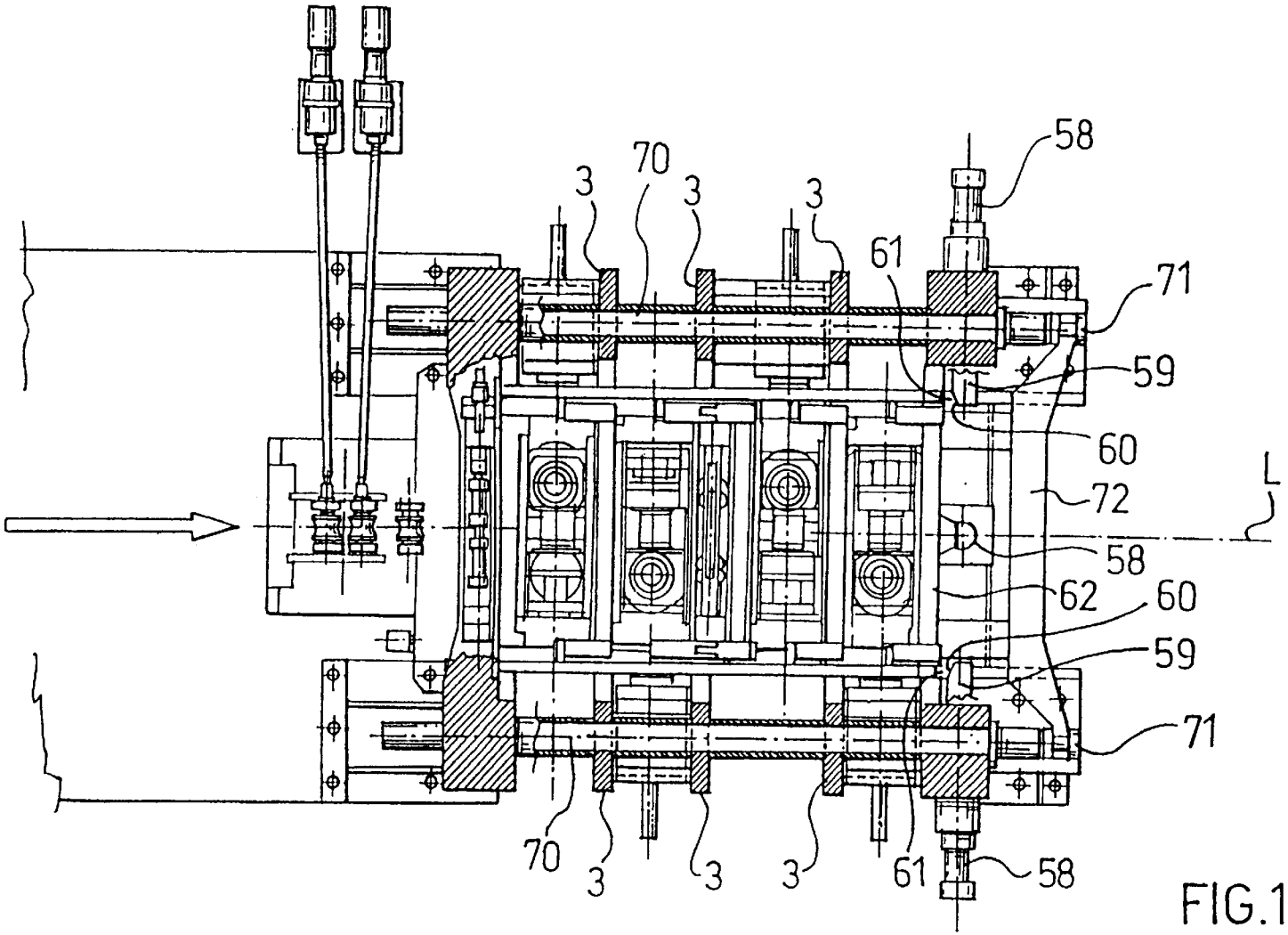
Figure 13:
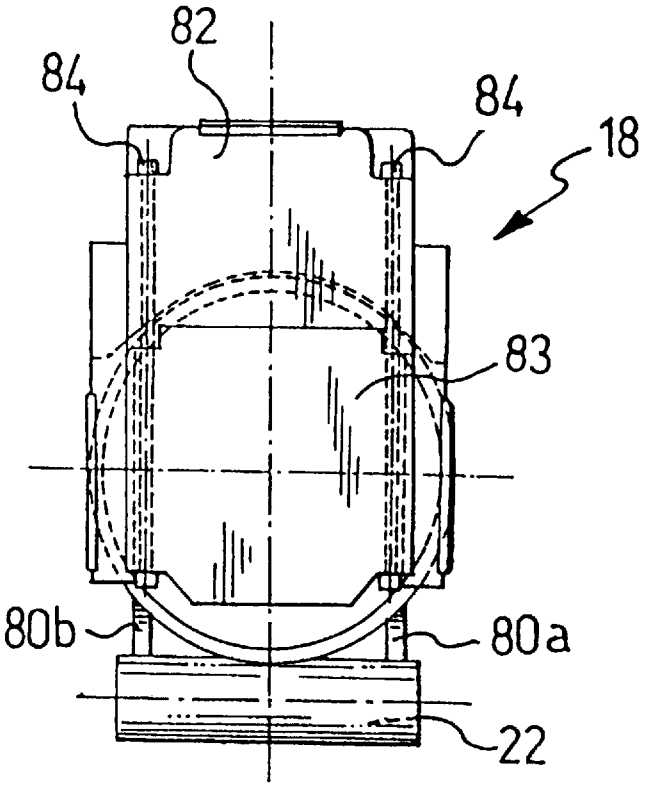
Figure 12:
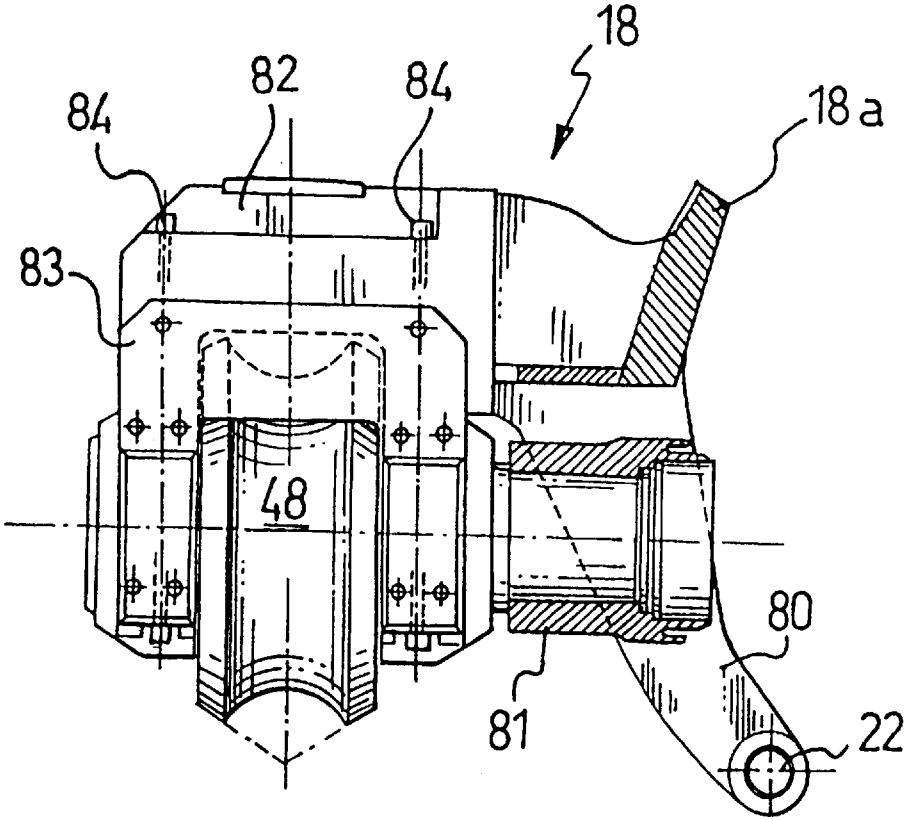

The invention as a whole with its features and the advantages resulting therefrom will become clearer from the following detailed description of a preferred but not exclusive embodiment thereof, illustrated in the appended drawings, in which:

FIG. 1 shows, as already stated, the condition of a lever arm after it has been re-turned, without adjustment of the pin, FIG. 2 is a perspective view of a rolling mill according to the invention, FIGS. 3, 3*a*, 3*b* show schematically the adjustment of the pivot points of the lever arms according to the invention, FIG. 4 is a longitudinal section through a portion of the rolling mill of FIG. 2, FIG. 5 is a section taken on the line V—V of FIG. 4, FIGS. 6 and 7 show a roll-holder frame extracted from the outer structure of the rolling mill, in respective operative conditions, FIG. 8 shows a detail of FIG. 5 on an enlarged scale, FIG. 9 shows schematically the operation of the detail of FIG. 8, FIG. 10 is a detailed side view of the supporting feet of a roll-holder of the rolling mill according to the invention, FIG. 11 is a partially-sectioned plan view of the rolling mill of the previous drawings, FIGS. 12 and 13 are respectively a front and a side view of a lever arm of the rolling mill of the invention, respectively.

With reference to the drawings indicated above, a rolling mill according to the invention is generally indicated 1 therein.

The rolling mill comprises an outer load-bearing structure 2 consisting of a series of platelike elements 3 with an annular shape, disposed side by side at predetermined distance from each other along a longitudinal axis L of the rolling mill, which is also the rolling axis where the pipes to be processed advance; the plate-like elements 3 stand on a base 4 shown schematically in the drawings, and are held rigidly together by ties or by spacers 5 likewise it is already known from the Italian patents cited above.

Within this structure 2 there are roll-holders 10 which are arranged in a pack and are considered in detail below; for brevity, reference will generally be made to only one of them.

Each holder 10 comprises an end wall 11 wherein a hole 12 is formed centrally for the passage of the pipes being processed, and a stiffening body 13 configured substantially as a flat frame disposed facing the aforementioned wall, to which it is connected rigidly by three blocks 14, 15 and 16. As can be seen in particular from FIGS. 4 and 6, the end wall 11 and the stiffening body 13 have a polygonal outer edge which fits the spaces present in the interior in an optimal manner; the profile of this edge may however be different from that shown, in dependence on various design selections.

The three blocks 14–16 are spaced apart so as to allow the three lever arms 18, 19, 20 to pivot freely about respective pivots 22, 23, 24, as shown in FIGS. 6 and 7; that is, the blocks 14–16 are spaced apart sufficiently to enable the arms 18–20 to be housed among them.

In this situation, the importance of the fact that the pivots 22–24 are disposed in the regions of the blocks 14–16 should be stressed; this in fact makes it possible for the holder 10 to remain laterally and for the arms 18–20 thus to swing freely as mentioned above, since their rotary movement is not hindered by any element connecting the end wall 11 to the stiffening body 13.

The holders 10 are fitted in the outer structure 2 of the rolling mill from the downstream end thereof, that is, the end from which the rolled pipes come out; they are slid along two guides 26 and 27 which extend parallel to the axis L and are fixed to the plate-shaped elements 3.

In particular, the holders 10 are arranged in the structure 2 in a manner such that their blocks 14–16 form a triangle which is substantially symmetrical with respect to a vertical direction V passing through the rolling axis L (see in particular FIGS. 3, 5 and 6); the reason for this "substantial" symmetry will be explained further below.

Moreover, according to a preferred embodiment of the invention, the holders 10 have in the region of their two blocks 15 and 16, located at a lower level than the rolling axis L in the structure 2, respective feet 30 and 31 forbearing on the guides 26 and 27.

In this embodiment of the invention, there are four feet 30 and 31, two for each side of the holder, and the feet project from the holder towards the above-mentioned guides; the feet are also adjustable: this means that they can be adjusted in order to vary the positions of the blocks 15 and 16 associated therewith.

This adjustment of the support feet 30, 31 takes place by means of respective devices provided inside the feet.

With reference to FIG. 8, each of these devices comprises a pillar-like element 32 having a rounded lower end 32*a* which bears on a concave base 33; the base 33 is in practice the portion of each support foot 30, 31 which is intended to slide along the two guides 26 and 27, supporting at the same time the element 32 in a pivotable manner, that is, permitting slight inclinations thereof relative to the vertical V. Means, not shown in the drawings, may be provided between the pillar element 32 and the base 33 for keeping the former coupled with the latter, preventing slipping disconnection thereof.

The element 32 is guided for sliding in a hole 34 extending through the interior of the respective support foot of the holder and a spacer 37 which is fixed above it and which can be replaced according to the desired adjustment, is fixed to the upward-facing surface of the foot by bolts 36.

As will be better understood later, the device just described enables the desired adjustment of the pivots 22–24 of the lever arms 18–20 to be achieved by raising and lowering the supporting feet of the holder; however, before considering this aspect of the invention in detail, it is appropriate to complete the description of the rolling mill 1 as a whole.

After the holders 10 have reached their working position inside the structure 2 of the rolling mill, they are clamped vertically by four hydraulic cylinders 38 acting on the blocks 15 and 16 of each holder from below (two for each side of the holder, situated in the vicinity of the guides 26 and 27) in cooperation with the same number of right-angled abutments 39 fixed to the structure 2.

As far as the stopping of each holder 10 in a horizontal direction is concerned, this is performed by means of a thrust member 40 which acts on the holder horizontally, thus bringing the spacers 37 into contact with the right-angled abutments 39 disposed on the opposite side.

Finally, in order to stop each holder more safely in the working position, in this embodiment a further thrust member 41 is provided, acting on the upper block 14 along the vertical axis V.

The adjustment of the positions of the lever arms 18–20, that is the regulation of their swinging about the respective pivots 22–24, is carned out, by known means similar to those mentioned in the patents which have been cited several times and to which reference should be made for further information.

By way of summary, it suffices to say that these means are hydraulic or electromechanical cylinder-piston units 43, 44, 45, in which one portion (usually the cylinder) is fixed between two plate-like elements 3 of the rolling mill, whereas the other portion (that is, the piston) is movable to and for along a radial axis relative to the rolling axis L. The movable portion acts on the arm so as to prevent swinging thereof, thus maintaining the distance of the axis of rotation of the respective roll from the rolling axis L in accordance with predetermined adjustment parameters.

If these cylinder-piston units are electro-mechanical, they are also commonly known as "screws" since the movable portion is translated by virtue of a threaded coupling with the fixed portion, whereas in the hydraulic solution they are also known as "capsules".

Each lever arm 18–20 supports a respective working roll 48, 49 or 50 driven by means of a corresponding extension 51, 52, 53 connected to drive means not shown in the drawings; moreover, each of the aforesaid arms has an appendage 18*a*, 19*a*, 20*a* which serves as the point of application of the force exerted by a balancing mechanism 55. The latter is an articulated system in which a hydraulic actuator 56 acts on one end of a rocker 57 swinging about a fixed axis on the structure 2 of the rolling mill; at its opposite end, the rocker 57 exerts a force on the appendage 18*a*–20*a* of the corresponding arm so as to balance the overall weight thereof (also including that of the roll and of the respective carrier), thus ensuring a predetermined condition of contact with the cylinder-piston unit 43, 44, or 45.

In the rolling mills of the prior art described in the above-mentioned patents, this function was performed by springs or other equivalent systems which, however, were disposed inside the roll-holders; in the solution according to the present invention, on the other hand, the balancing mechanisms 55 are mounted on the structure 2 of the rolling mill and their weight therefore no longer bears on the roll-holders 10 which are thus made lighter, thereby facilitating their handling According to a preferred embodiment of the rolling mill described up to now, the lever arms 18, 19, 20 of one holder 10 are arranged in a configuration in which they are overturned about the vertical direction V, with respect to those of the adjacent holder in the pack; the drive extensions are thus parallel to those of the adjacent holder, thereby simplifying the arrangement of the drive motors of the rolls around the structure 2 (in this connection, see FIGS. 1 and 5, in the second of which the extensions of an adjacent holder are indicated in broken outline).

In particular, in the case of rolling mills with three rolls per holder, as in this embodiment, the preferred arrangement of the arms and of the holders is that shown in the drawings, that is, with the upper block 14 arranged along the vertical direction V and with the drive extensions at 120° to one another, one extension being parallel to such a direction.

The configuration of the roll-holders 10 and their arrangement in the rolling mill thus provides a further advantageous effect of the invention.

Indeed, all of the respective blocks 14–16 are aligned with one another along lines parallel to the longitudinal axis L, throughout the pack of holders in the structure; with reference to FIG. 5, these lines are perpendicular to the plane of the sheet and pass through the blocks 14–16 of the holder visible therein.

In order to form the pack of holders in the structure 2 and to take up any play between therein, in the rolling mill according to the invention, it is consequently possible to pack them together by exerting an axial thrust from the end of the rolling mill, that is, from its downstream end where the rolled pipes come out, along the lines on which the blocks 14–16 are aligned.

These blocks are in fact the points of the holders 10 most suitable for withstanding stresses applied axially, given that the end wall 11 and the stiffening body 13 can certainly not perform this task unless they have a thickness such as to render the holders considerably heavier.

Three clamping devices 58 are therefore fitted on the downstream end of the rolling mill 1, each consisting of a hydraulic cylinder having a slider 59 movable towards the interior of the structure 2 and having an inclined active surface 60 which, when the slider is in the advanced position, applies an axial force to a respective buffer 61 disposed along one of the lines on which the blocks 14–16 are aligned.

The buffer 61 may advantageously be formed, as in this embodiment, on an end element 62, constituted by a plate which is perforated centrally to allow the pipes to pass through and which closes the pack formed by the holders 10 present in the structure 2, serving for the removal and insertion thereof by a system which will be described below.

Before proceeding, it is appropriate to state that in this embodiment of the invention, the holders 10 located in the structure 2 are connected to one another by hooks 65 so that they can be moved towards the outlet along the guides 26 and 27 by being pulled together like trucks of a railway train.

Of course, the hooks 65 are disengaged in order to release the individual holders when required; for this purpose, they are articulated so that they can pivot relative to the support feet 30, 31 of the respective holders 10 and, according to a preferred solution, they are disposed alternately on one side of the axis L and on the other; this allows the holders to be moved transverse this axis when they are outside the structure 2 in accordance with a scheme which will be explained further below.

In this connection, it should be added that the hooks 65 permit a certain relative movement of the holders which can be spaced apart by a few centimeters when they are pulled towards the outlet of the rolling mill together; finally, it should be noted that the end element 62 also has hooks 65 so that it can be connected to the holder adjacent thereto.

For the removal and insertion of the holders 10, the rolling mill 1 contains two hydraulic cylinders 70 which are parallel to the axis L, and are situated on opposite sides thereof, and extend through the circular plate-shaped elements 3 that form the outer structure 2 of the rolling mill.

The ends 71 of the hydraulic cylinders which face the outlet of the rolling mill, are joined together by a cross-member 72 which in turn is fixed frontally to the plate that constitutes the end element 62 of the pack of holders.

When the holders are to be extracted from the structure 2, the hydraulic cylinders are activated and their ends 71 with the cross-member 72 move towards the downstream end of the rolling mill, that is, towards the right with reference to FIG. 11; as a result of this movement, the end element 62 which is fixed to the cross-member 72, pulls the holders 10 connected thereto towards the output of the rolling mill by means of the hooks 65.

It is just necessary to point out that downstream of the structure 2, there is a loading-unloading device not shown in the drawings, which is known per se and which may be constituted, for example, by a trolley of the type described in the Italian patents indicated above, for receiving the holders and transporting them away from or towards the rolling mill.

Finally, as a further important innovation present in the embodiment of the rolling mill according to the invention described up to now, it must be emphasised the particular configuration of the lever arms 18,19, 20, only one of which is shown in FIGS. 12, 13 and will be referred to for sake of brevity (the other two are identical).

The lever arm 18 comprises a fixed portion 80, that is, a portion which remains the same regardless of the size of the pipe to be rolled by the arm, this portion extending from the seat 81 housing the pivot 22. The fixed portion is formed by two flat half-arms 80*a*, 80*b* between which a coupling 81 for the connection of the roll 48 to the respective drive extension, is disposed.

The fixed portion 80 of the arm, on which the aforementioned appendage 18*a* is also situated, terminates with an end 82 supporting a chock 83 wherein the roll 48, which can rotate freely about its axis, is mounted; the chock 83 is fixed to the end 82 that supports it, by means of four large bolts 84 passing through both of them from side to side. Holes for the bolts may also advantageously be provided in other positions in the end 82, so that chocks of different sizes can be mounted according to the size of the working roll.

The lever arm 18 differs from those described in the prior Italian patents basically in that its fixed portion 80 has an end 82 through which the radial rolling forces are transmitted; since this end supports the yoke-like chock 83, the aforementioned forces that act on the roll 48 are in fact transmitted by the bearings of the roll to the end 82 on which, it should be recalled, the hydraulic cylinder-piston unit 45 acts on the opposite side to the roll 48. Differently, in previous cases these forces affected only the yoke-like chock (and not the fixed portion of the arm) which therefore had to be reinforced adequately, thus inevitably becoming heavier.

In the present case the replacement of the chocks is therefore much easier.

With regard to the rolling operations which are carried out after the roll-holders 10 have been placed in the working position and clamped therein as described above, the rolling mill works in the same manner as in the examples described Italian patents cited above, the text of which is therefore incorporated in this description by reference and should be referred to for further information on this subject.

With regard to the adjustment of the pivots about which the lever arms swing, however, the following remarks should be considered.

As stated above, the support feet 30, 31 of the holders 10 are adjustable so that the positions of the corresponding blocks 15, 16, and consequently of the pivots 23, 24 associated therewith, can be varied.

This variation of position takes place as a result of lowering the support feet 30 on one side and raising the support feet 31 on the other side which, combined with a slight horizontal displacement thereof, brings about a rotation of the roll-holder 30 about the rolling axis L, as shown schematically in FIG. 3.

It should be pointed out that this rotation is in fact of the order of 1°–2° and has been magnified in the drawings for greater clarity and ease of comprehension.

In the drawing, the distance of each pivot 22–24 from the rolling axis L (which is perpendicular to the plane of the drawing and also represents the centre of the circle about which they rotate) is indicated R.

The initial distance of the axis of rotation of the rolls from the rolling axis L is indicated H, (for clarity of the drawing, only the roll 49 is marked), this distance being considered before the rotation of the holder, whilst ΔH represents the change in this distance as a result of the rotation performed.

The other component of the movement of the pivots 22–24, which is perpendicular to H, is indicated ΔB and is visible on an enlarged scale in FIGS. 3*a*, 3*b*; finally, the angle of the rotation undergone by the roll-holder is indicated "α" in the drawings.

With the use of these symbols, it is possible to write the following equations:

$$\Delta H = R \times \sin\alpha;\ \Delta B = R \times (1 - \cos\alpha);$$

from which it can be seen that by giving practical values to the variables, for example ΔH=15 mm and R=1200 mm, there is found that α=0.716° and ΔB=0.094 mm.

In practice, the displacement ΔB of the rolls 48–50 along their axes which results from the rotation impaired to the holder 10 is negligible and does not therefore lead to significant effects in the adjustment of the rolling mill, particularly bearing in mind that the rotation of the holders 10 is performed before the turning of the rolls and the effects of the displacement ΔB can thus be compensated during this machining.

In other words, the displacement ΔB involves a translational movement of the profile of the roll relative to its initial plane of symmetry, but it does not in this case lead to the adverse effects explained at the beginning of this description with reference to the rolling mills of the prior patents, either because it is of negligible magnitude and because it can be compensated by the turning of the rolls.

According to the embodiment described herein, the supporting feet 30 and 31 are adjusted before the roll-holders ION are inserted in the rolling mill.

This means that when a roll-holder 10 is outside the structure 2, it is inclined in the manner required for adjustment, for example as shown in FIG. 9; it is then held in this condition by the spacers 37 required for the adjustment which are fixed on top of the support feet 30, 31 by means of the bolts 36 and underneath which the pillar elements 32 push.

The holder thus arranged is then inserted in the structure 2 by sliding of the bases 33 on which it rests along the guides 26, 27 and, when the holder reaches the desired position, the thrust member 40 acts horizontally, moving the holder 10 towards the left-hand right-angled abutment 39 (with reference to FIG. 9) until the corresponding spacer 37 is in abutment therewith.

At this point, the four hydraulic cylinders 38 located underneath the holder are activated so as to urge it upwards, until the spacers 37 come into contact with the abutments 39.

It should be pointed out that the aforesaid spacers are shaped in a manner such that their upper surfaces are at the same height (see FIG. 9); it should also be noted that, when the holder is raised by the cylinders 38, its weight no longer rests either on the guides 26, 27 or on the elements 32 and the bases 33.

A suitable selection of the vertical and horizontal displacements of the holder 10 as just described, enables the desired rotation to be imparted thereto in order to achieve the above-described adjustment of the pivots 22–24.

As a consequence the object of the present invention constituted by this adjustment, is thus fully achieved.

Moreover, it should not be overlooked that the invention achieves further important results.

Amongst these the configuration of the roll-holders 10, which are open laterally so as to allow the lever arms 18–20 to be tilted fully outwards (FIG. 6), should be noted; this facilitates maintenance or replacement operations of the working rolls, which are carried out by extracting the holders from the outer structure of the rolling mill.

In this connection it should be noted that, in the prior patents, to permit these operations the roll-holders have a fore open configuration, that is, they are open on the side corresponding to that on which the stiffening body 13 is now disposed; this in fact affords free access to the rolls for maintenance or replacement thereof, given that in these patents it is not possible to tilt the lever arms fully outwards.

This fact leads to the holders having less structural strength with respect to the axial stresses which arise during rolling, particularly when operating with a mandrel.

The axial stresses are indeed those which act in a direction parallel to the rolling axis and which tend to bend the roll-holders in this direction; the fore open configuration of these holders does not therefore provide a good resistance to this bending and in order to compensate for this situation, it is therefore necessary to form thicker, and hence heavier, holders.

In the present invention, on the other hand, the holders formed by the end wall 11 and by the stiffening body 13 joined together with by a series of blocks 14–16 in the region where the pivots of the swinging arms are disposed, provide a solution which is resistant to axial stresses and can therefore be lighter, and hence also easier to handle, than the variants of the prior art mentioned.

A roll-holder of this type is also -particularly suitable for rolling mills with a tubular outer structure, that is, those which are preferable for the rolling of pipes on a mandrel.

In rolling mills of this type, the changing of the holders in fact takes place axially relative to the outer structure (and not radially, for obvious reasons), and it is therefore necessary to provide, inside the structure, guides or similar sliding means along which the holders are moved; these holders must in turn have bearing feet for resting on the guides or equivalent means.

Since in this embodiment there are blocks 14–16 which connect the end wall 11 to the stiffening body 13 in the roll-holders, the fitting of the supporting feet 30, 31 on these blocks is facilitated and does not hinder the outward tilting of the lever arms.

Finally, a few words should be spent about the holder-extraction system provided in the rolling mill of this invention.

Indeed, the feature which differentiates this system from the prior art described in the patents already referred to herein, is that it acts from the end of the rolling mill, that is, from its downstream end where the processed pipes come out.

This achieves the considerable advantage that, if an accident occurs to the working rolls of a holder which is inside the pack formed in the outer structure of the mill during rolling, it is not necessary to remove all of the holders.

For example, in the case of so-called stoppage of the pipe, that is, when the pipe is not drawn along correctly by the working rolls and may accumulate between one rolling stand and the next, at the same time being tightened onto the mandrel, it is not possible to make the pack of holders to slide by pushing them from the inlet end of the rolling mill towards the outlet end, because the working rolls which are upstream of the accumulated pipe are blocked and prevent any movement.

With the removal system according to the invention, on the other hand, it is possible to withdraw at least those holders which are downstream of the point where the stoppage of the pipe has occurred; they are indeed pulled towards the output of the rolling mill by the extraction device which, as stated, acts from the outlet end of the outer structure 2 and not from the only one.

The extraction of the holders 10 from the outer structure of the rolling mill is also considerably facilitated by the fact that engagement means are provided between one holder and another so that they, can be pulled together; clearly this avoids the need to extract them one at a time, thus rendering all the operations simpler and quicker.

In addition, it should also be stressed that the hooks 65 which permit a certain relative spacing between the holders, allow those which have been extracted to be moved transverse the axis L.

In other words, when the pack of holders is brought out of the structure 2, the pull exerted on them and the friction of their support feet 30, 31 on the guides 26, 27 cause them to space out in accordance with the slippage permitted by the hooks 65.

The distance between the various extracted holders (a few centimeters) facilitates their individual movement in the above-defined transverse direction which serves, for example, for their internal inspection one by one or for maintenance, as required.

In this context it should be noted that the particular arrangement of the hooks 65 mentioned is intended to allow adjacent extracted holders 10 to be moved alternately, that is shifted, to one side of the axis L and to the other, according to a scheme which facilitates operations for replacing them with new holders that can be prepared beside those extracted, given that the distance between the latter is such as to permit this.

Obviously variants of the invention with respect to the embodiment described herein should not be excluded.

By way of indication, it is indeed not difficult to envisage that the means for bringing about the rotation of the roll-holders 10 in order to adjust the positions of the pivots of the lever arms, may differ even considerably from the devices described herein.

For example, it should be pointed out that it is not necessary for the aforementioned rotation to take place before the holders are inserted in the structure of the rolling mill.

Moreover, it is also possible to consider the use, instead of the elements 32, the bases 33 and the various hydraulic cylinders 38 and thrust members 40, solely of the spacers to be placed under the support points of the holders 10 on the guides 26 and 27, like wedges; in the same way, the possibility of bringing about the rotation of the holders purely with hydraulic cylinders or similar means, such as of electromechanical type, should not be excluded.

In other terms this rotation could be achieved purely by cylinders or jacks positioned under each holder in the same manner as those indicated 38 in the embodiment considered herein, or incorporated in the support feet 30 and 31.

More generally, the technical solution by which the holders are rotated may be said to depend upon the design selection most suitable for the circumstances and hence also upon the shape of the outer structure of the rolling mill which, in the embodiment described above, is tubular with cylindrical geometry but a different shape such as, for example, a laterally open shape should not be excluded.

Furthermore, it is easy to understand that the number of working rolls and of respective swinging arms present in each holder could also be other than the three considered above. Finally, it should also not be forgotten that various devices useful for rolling, such as apparatus for guiding the mandrel and/or the pipes, may be provided within the rolling mill, upstream or downstream thereof, but also in an intermediate position.

The presence of these apparatus may also depend upon the type of use of the rolling mill of the invention; although the rolling mill of the invention is particularly suitable for processing seamless pipes with a mandrel, the possibility of its use also for bars or rodshaped bodies in general, such as rods, wires, etc., should not be excluded.

What is claimed is:

1. A rolling mill for pipes or rod-shaped bodies, comprising:

an outer load-bearing structure arranged along a rolling axis;

one or more roll-holders extractable from the outer structure;

a plurality of working rolls for each holder;

a lever arms on which each roll is mounted, the lever arms swinging in planes transverse to the rolling axis;

a pivot connecting each lever arm to the holder;

means for guiding the sliding of the holders in the outer load-bearing structure; and, means for rotating the roll-holders about the rolling axis to adjust the positions of the pivots of the lever arms.

2. A rolling mill according to claim 1, wherein the means for rotating the roll-holders comprise a plurality of hydraulic and/or electro-mechanical thrust members acting on each holder.

3. A rolling mill according to claim 1, wherein at least a part of the means for rotating the roll-holders is provided on each holder.

4. A rolling mill according to claim 3, wherein the means provided on each roll-holder comprise bearing feet supported on the guide means the bearing feet being adjustable in height.

5. A rolling mill according to claim 4, wherein the bearing feet are adjustable so as to enable the respective roll-holder to be inserted in the outer structure, in a rotated condition with respect to the rolling axis.

6. A rolling mill according to claim 5, wherein each bearing foot comprises a base slidable on the guide means, a pillar element mounted on the base so as to be pivotable and sliding axially in a seat associated rigidly with the rest of the holder, and a spacer fixed to an upper part of the seat and to the pillar element.

7. A rolling mill according to claim 1, wherein the outer load-bearing structure is tubular and the guide means extend parallel to the rolling axis in the aforesaid structure in a position below the rolling axis.

8. A rolling mill according to claim 1, wherein each roll-holder comprises an end wall and a stiffening body having substantially the shape of a flat frame with a profile homologous to that of an edge of the end wall, the end wall and the stiffening body being disposed opposite one another and connected to each other rigidly by a plurality of blocks on which the pivots of the lever arms are disposed, the blocks being spaced apart so as to allow the lever arms to twist out of the holder.

9. A rolling mill according to claim 8, wherein at least some of the blocks of the roll-holders are located at points where the roll-holders rest on the guide means.

10. A rolling mill according to claim 7, wherein the roll-holders are extractable from the outer load-bearing structure by being pulled from an end thereof where the rolled pipes or bodies come out, and by being pulled from means.

11. A rolling mill according to claim 10, comprising two or more hydraulic pistons arranged parallel to the rolling axis and connectable to the roll-holders in order to pull them out the roll holders.

12. A rolling mill according to claim 10, wherein the roll-holders have engagement means for connecting the roll-holders to one another so that the roll-holders are extractable from the outer load-bearing structure by being pulled together.

13. A rolling mill according to claim 1, wherein the lever arms extend from the respective pivots to a projecting end where a yokel chock is fixed removably, in a manner such that in a working condition, a corresponding roll is in a position between the projecting end and the rolling axis.

* * * * *